United States Patent [19]

Cumming et al.

[11] Patent Number: 4,698,074

[45] Date of Patent: Oct. 6, 1987

[54] AIR CLEANING APPARATUS

[75] Inventors: Newell E. Cumming; James H. Sidell, both of Encino, Calif.

[73] Assignee: Cumming Corporation, Chatsworth, Calif.

[21] Appl. No.: 12,605

[22] Filed: Feb. 9, 1987

[51] Int. Cl.[4] ..... B03C 3/01; B03C 3/09; B03C 3/12

[52] U.S. Cl. ..... 55/126; 55/131; 55/138; 55/143; 55/152; 55/154

[58] Field of Search ..... 55/126, 130, 131, 136, 55/143, 145, 141, 152, 154, 137, 138

[56] References Cited

U.S. PATENT DOCUMENTS

| | | | |
|---|---|---|---|
| 977,335 | 11/1910 | Shaffner | 55/129 |
| 2,556,982 | 6/1951 | Roos et al. | 55/131 |
| 3,668,836 | 6/1972 | Richardson et al. | 55/154 X |
| 4,496,375 | 1/1985 | Le Vantine | 55/131 |

OTHER PUBLICATIONS

Cumming Corporation Brochure entitled "The Dust Destroyers".

*Primary Examiner*—Kathleen J. Prunner
*Attorney, Agent, or Firm*—William W. Haefliger

[57] ABSTRACT

An electrostatic air cleaning device, comprising:

(a) a housing including an upright tubular shell, having an upper air inlet and a lower air outlet, (b) a fan in the housing for effecting air flow into the inlet, downwardly in the shell, and out the outlet, (c) an upright post in the shell, (d) a frame received downwardly in the shell, and vertically spaced, electrically conductive grids carried by the frame; the grids defining openings to pass the post as the frame is received downwardly into the shell, (e) an electrical cable associated with the post, and tips connected to the cable and exposed to air spaces defined between the grids, and (f) circuitry to supply high voltage of one polarity to the cable tips, the grids being at a different voltage level such that ions discharged from the tips cause collection at the grids of particulate in air flowing downwardly in the shell.

12 Claims, 4 Drawing Figures

AIR CLEANING APPARATUS

BACKGROUND OF THE INVENTION

This invention relates generally to air cleaning, and more particularly to a simple, low cost, positive airflow, easily cleanable, and optimally portable air cleaning unit, of unusually superior construction.

Air cleaning units are known, wherein air-borne particulates are caused to precipitate onto grids. Typically, air is depended upon to flow through a succession of such grids, as in U.S. Pat. No. 4,496,375.

What is needed, however, is more simple, more dependable construction; means to enable ready cleaning of the grids; means for assured positive air flow through the grids; and greater portability. Also needed is shielding against radiation from the unit that would interfere with radio, television and other electrical equipment.

SUMMARY OF THE INVENTION

It is a major object of the invention to provide an improved, superior air cleaning device meeting the above needs. Basically, the device of the invention comprises:

(a) housing means including an upright tubular shell, having an upper air inlet and a lower air outlet,
(b) a fan in said housing means for effecting air flow into said inlet, downwardly in the shell, and out said outlet,
(c) an upright post in the shell,
(d) a frame received downwardly in the shell, and vertically spaced, electrically conductive grids carried by the frame; the grids defining openings to pass the post as the frame is received downwardly into the shell,
(e) electrical cable means associated with the post, and tips connected to said cable exposed to air spaces defined between the grids, and
(f) means to supply high voltage of one polarity to the cable and tips, the grids being at a different voltage level such that ions discharged from said tips cause collection at the grids of particulate in air flowing downwardly in the shell.

As will appear, the frame typically includes upright supports that slidably interfit upright guides carried by the shell to enable ready removal of the frame and grids from the shell via its top; there are at least three of such grids carried by the frame, the grids having annular disc configuration; the grids typically have screen disc construction and define inner circular peripheries close to the post, and outer generally circular peripheries close to the shell; channels are typically received in notches formed by the grids which are typically grounded; and wherein said (f) means supplies between about −11,000 VDC and −22,000 VDC to the cable and tips; and the cable means extends upwardly within the post, and the post defines side ports receiving the tips which are exposed to open spaces between the grids.

These and other objects and advantages of the invention, as well as the details of an illustrative embodiment, will be more fully understood from the following specification and drawings, in which:

DRAWING DESCRIPTION

DETAILED DESCRIPTION

Figure 1:
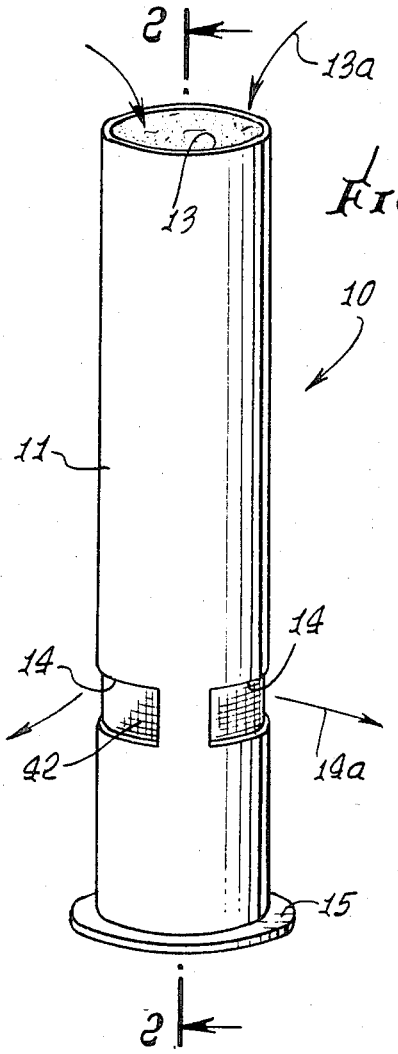
FIG. 1 is an elevation, in perspective, showing one form of the invention.

In the drawings, the electrostatic air cleaning device 10 shown includes housing means typically incorporating an upright tubular shell 11 made of molded plastic material. The shell has an upper air inlet 13 and a lower side outlet or outlets 14 for discharging clean air into a room. See entering arrows 13*a* and outflow arrows 14*a*. The shell also incorporates a base in the form of an integral flange 15, whereby the device may be placed and supported anywhere in a room, as for example on a table, desk, floor, etc. This enables discharge 14*a* at an easily selected level in a room.

Integral with the shell inner wall are four vertical guide channels 16, located at 90° intervals about the shell central upright axis. The channels project inwardly as shown, and extend upwardly to locations 16*a* near the top of the shell, and downwardly to locations 16*b* near the bottom of the shell. The channels may consist of lightweight metal such as aluminum.

A frame 17 is received downwardly into the shell interior 18, and typically includes vertically elongated channel members 19 located 90° guidedly interfit or embrace the channels 16, so that the frame is guided vertically downwardly into the shell, i.e. not rotatably loose in the shell. The frame seats on a transverse partition 20 peripherally attached to guides 16, and supporting an upright post 21. Partition 20 includes a leg 20*b* extending radially inwardly to support the post 21. Thus, air may freely flow downwardly through the large gaps between the legs 20*b*. Post 21 protects electrical cable means and tips, to be described.

The frame carries multiple grids 22–25 which are peripherally attached to channels 19 as via brackets 26. The grids may be of electrically conductive screen mesh type construction; they are annular and disc-like to form openings 27 for passing the post 21 without contacting same as the frame and grids are lowered into the shell as after grid cleaning; and they are vertically spaced, as shown. At least three grids are provided, and they together with the frame are at a voltage level $V_1$, as for example ground level indicated at 27.

Electrical cable means 30 is associated with the post, together with ion dispensing tips 31 projecting laterally from the cable as via lateral openings 32 in the post. High voltage is applied to the tips via the cable means; thus, voltage level $V_2$ between about −11,000 and −22,000 VDC may be supplied to the tips, as via a power supply unit 34 at the bottom of the unit, a plug and cord 35 may be employed to plug the supply into a receptacle in the room wall, adding to the convenience of use of the device anywhere in the room. $V_2$ and $V_1$ are at different levels, as indicated.

Ions discharge from the tips 31 and to spaces between the grids at voltage $V_2$ causing collection at the grids (at voltage $V_1$ ) of particulate (dust, pollen, etc.) in air flowing downwardly in the shell, thereby electrostatically cleaning the air. As referred to, the frame and grids are easily upwardly removed, whenever desired, generally by lifting the frame from the open to top of the shell. A foam pre-filter 38 is removably fitted in the top of the shell, to prevent dust collection on the top grid, and to remove larger particulate, reducing need for cleaning the interior. It may have activated charcoal pieces therein.

A fan 41 is also provided in the shell, for effecting air flow downwardly through the top inlet 13 and outwardly via outlets 14. The latter may be covered as by screen 42. The fan 41 is carried by a vertical drive shaft 43 driven by motor 44. Radial legs 45*a* of support 45 attached to guides 16 centrally carries the motor, as shown. The motor is cooled by the downward air flow.

Figure 3:
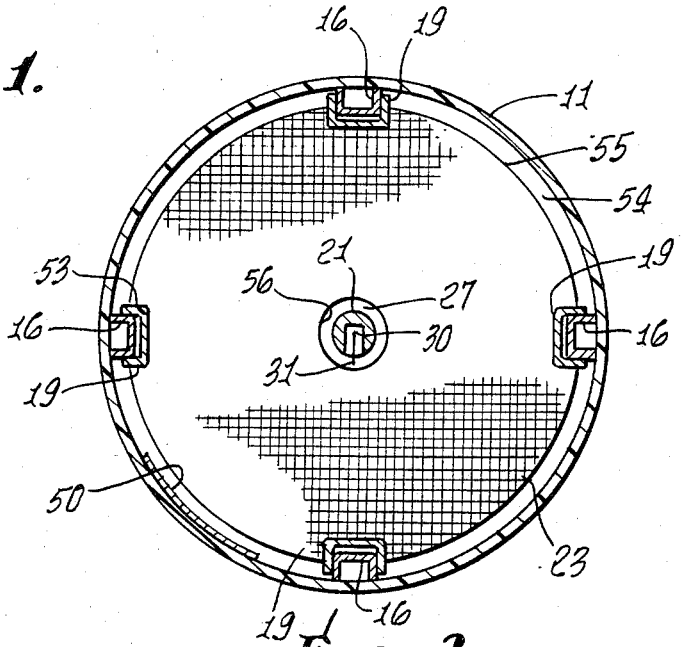
FIG. 3 is a horizontal section taken on lines 3—3 of FIG. 2.

FIG. 3 also shows a portion of a thin conductive cylindrical shield 50 lining the shell to block electromagnetic radiation sidewardly from the shell. The shield typically extends vertically from the top to the bottom of the shell, and may consist of aluminum foil. It also typically extends cylindrically about the shell axis. It may be removable and also act as a particulate collector.

Figure 4:
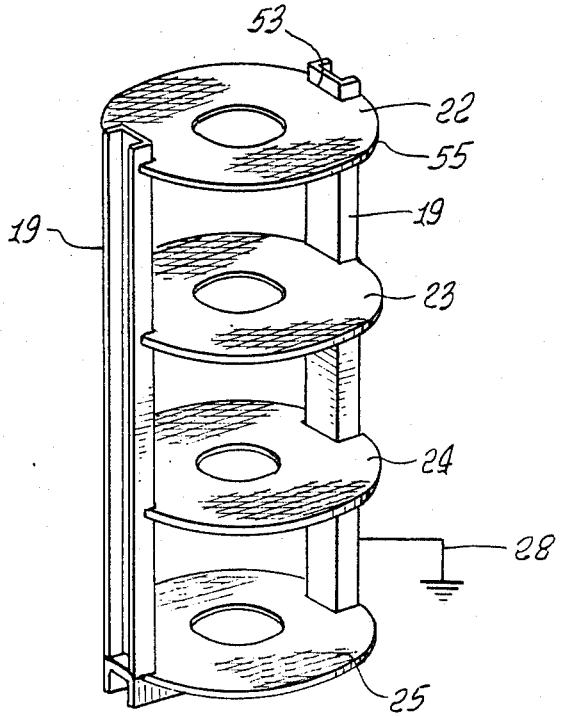
FIG. 4 is a perspective view, in elevation, showing a modified grid and frame structure.
Figure 2:
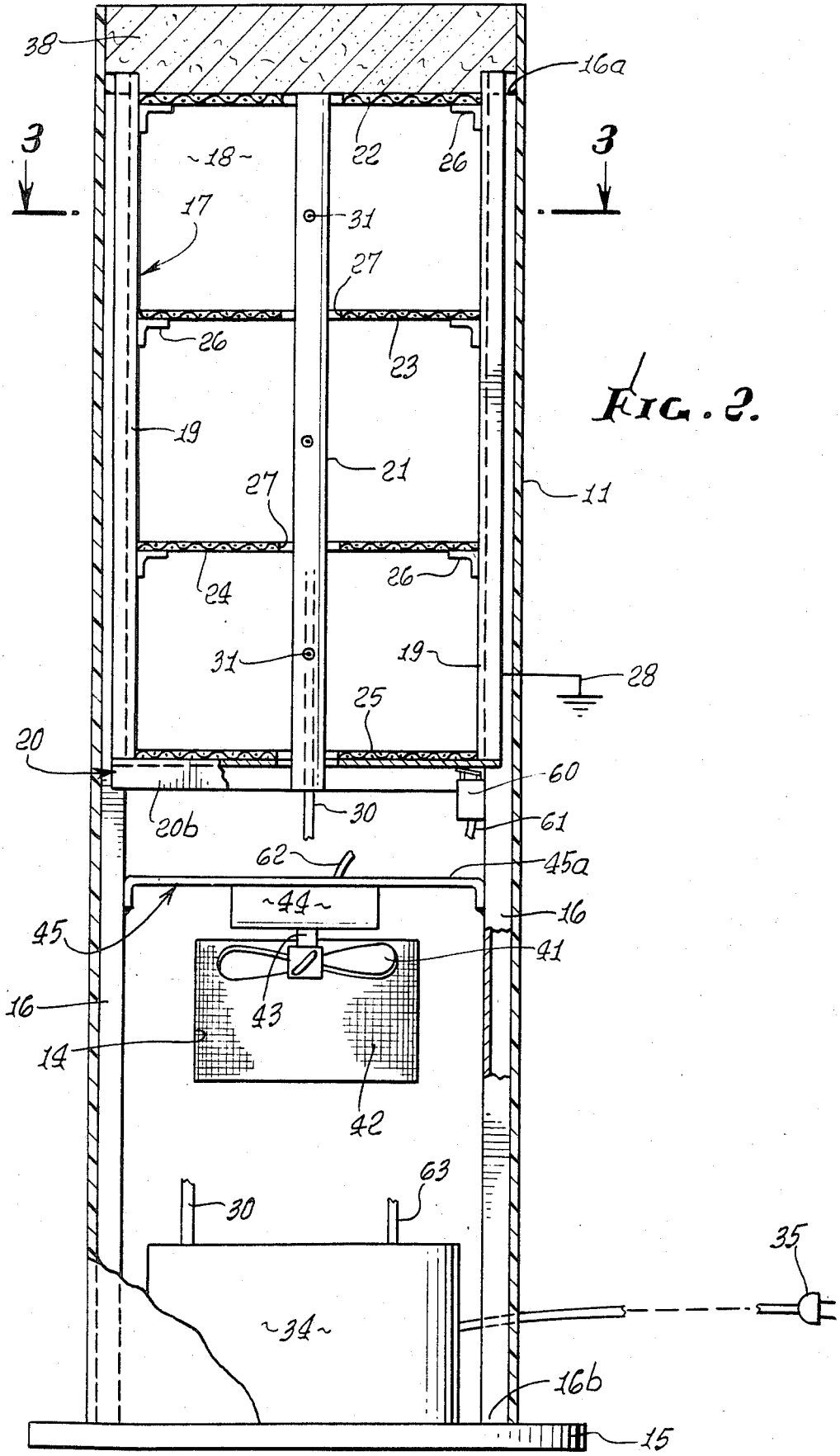
FIG. 2 is an enlarged section taken in elevation on lines 2—2 of FIG. 1.

FIG. 4 shows a modified frame and grid structure employing only two channels 19 instead of four such channels seen in FIG. 3. The grids may be riveted, soldered or brazed to the channels, and the channels are typically received in notches 53 formed in the grids so that the grids' outer peripheries 55 may extend very close to the shell wall, minimizing air flow by-passing of the grids in the gaps 54. Note the close proximity of the grid inner peripheries 56 to the insulative plastic post 21, also to minimize air by-passing.

A micro switch 60 may be positioned to be actuated when the frame and grids are seated in position, as shown, to initiate operation of the fan motor and the power supply 34. See terminals 61–63. Grids 22–25 may consist of aluminum screen.

We claim:

1. In an electrostatic air cleaning device, the combination comprising (a) housing means including an upright tubular shell, having an upper air inlet and a lower air outlet, (b) a fan in said housing means for effecting air flow into said inlet, downwardly in the shell, and out said outlet, (c) an upright post in the shell, (d) a frame received downwardly in the shell, and vertically spaced, electrically conductive grids carried by the frame; the grids defining openings to pass the post as the frame is received downwardly into the shell, (e) electrical cable means associated with the post, and tips connected to said cable exposed to air spaces defined between the grids, and (f) means to supply high voltage of one polarity to the cable and tips, the grids being at a different voltage level such that ions discharged from said tips cause collection at the grids of particulate in air flowing downwardly in the shell.

2. The combination of claim 1 wherein the frame includes upright supports, and there being upright guides in the shell to guide the upright supports during vertical movement of the frame in the shell.

3. The combination of claim 2 wherein said upright supports have channel shape and open radially outwardly to receive the guides therein.

4. The combination of claim 3 wherein the grids have annular disc configuration, and define inner circular peripheries close to the post, and outer generally circular peripheries close to the shell, the channels received in notches formed by the grids.

5. The combination of claim 1 including a conductive shield lining the shell to block electromagnetic radiation sidewardly from the shell.

6. The combination of claim 1 wherein there are at least three of said grids carried by the frame, the grids having annular disc configuration.

7. The combination of claim 1 wherein four of the grids and said high voltage supply means are located in an upper portion of the shell and including a fan drive motor also in a lower portion of the shell.

8. The combination of claim 5 wherein said inlet is at the top of the shell, which is generally cylindrical, and said outlet is formed in a shell side wall.

9. The combination of claim 1 including a porous pre-filter at the top of the shell, to extend over the grids.

10. The combination of claim 1 wherein the grids are grounded, and wherein said (f) means supplies between about −11,000 VDC and −22,000 VDC to the cable and tips.

11. The combination of claim 1 including switch means to initiate operation of said fan and said high voltage supply when the frame and grids are received into the shell.

12. The combination of claim 1 wherein said cable means extends upwardly within the post, and the post defines side ports receiving said tips which are exposed to open spaces between the grids.

* * * * *